US006971717B1

(12) United States Patent
Rhodes

(10) Patent No.: US 6,971,717 B1
(45) Date of Patent: Dec. 6, 2005

(54) BACKREST

(75) Inventor: Paul Rhodes, Markham (CA)

(73) Assignee: IWI Ltd., Markham ( * ) Notice: Subject to any disclaimer, the term of this patent is extended or adjusted under 35 U.S.C. 154(b) by 0 days.

(21) Appl. No.: 10/868,864

(22) Filed: Jun. 17, 2004

(51) Int. Cl.[7] ..... A47C 7/02
(52) U.S. Cl. ..... 297/230.1; 297/230.11; 297/230.14; 297/452.63
(58) Field of Search ..... 297/230.1, 230.11, 297/230.14, 452.63

(56) References Cited

U.S. PATENT DOCUMENTS 2,182,253 A * 12/1939 Farrell ..... 297/230.11
2,557,269 A * 6/1951 Fox ..... 5/652
2,582,115 A * 1/1952 Goodeve ..... 297/230.11
3,679,261 A * 7/1972 Slabakov ..... 297/230.11
4,556,254 A * 12/1985 Roberts ..... 297/452.36
5,190,347 A * 3/1993 Shiow-Lan ..... 297/284.5
5,403,067 A * 4/1995 Rajaratnam ..... 297/230.14

* cited by examiner

*Primary Examiner*—Laurie K. Cranmer

(57) ABSTRACT

An adjustable backrest has a series of adjustable straps extending across a front opening cavity of a backrest support. The straps are held in a locked, fitted position by a series of buckles at one side of the backrest which engage and lock the straps. Each strap is acted on by a bias arrangement and urges the straps to a drawn position across the front open cavity. This drawn position is an initial setup position that allows fitting of the backrest for a particular user.

11 Claims, 5 Drawing Sheets

BACKREST

FIELD OF THE INVENTION

The present invention relates to backrests typically used in combination with chair seats and other seating support structures. In particular, the invention is directed to a backrest support which is easily adjusted to accommodate different spinal profiles.

BACKGROUND OF THE INVENTION

Lower back problems continue to be of concern to a large percentage of people. Acute lower back pain can severely restrict the activities of the inflicted person, as well as affect their mental outlook. Many back problems are often the result of muscle strain and are alleviated with or without treatment in approximately six to ten weeks. Proper back support can assist in the healing process and promote better posture (less back strain) on an ongoing basis.

In some cases, improper back support can contribute or prolong back pain. Many desk chairs, office task chairs, car seats, etc. are not specifically designed to provide proper support to a person's lower back. It is known to provide specialized supports or adjustable supports whereby a user can adjust the chair or support to a desired support position.

Customized back supports are certainly known, however, the ability to adjust these supports in a manner to promote better posture is often difficult and inconvenient.

There remains a need for a simple cost effective back support which can easily be adjusted by the end user to provide better support when it is used in combination with existing chairs and seating.

One type of adjustable back support uses a generally shallow U-shaped molded back rest support with a series of adjustable straps disposed across the open face of the U-shaped cavity. The lengths of the straps can be adjusted to accommodate the shape of the user's lower back. The existing systems are not convenient to use and do not provide a structure which simplifies the adjustment of a backrest such that errors in setting thereof are avoided.

SUMMARY OF THE INVENTION

A backrest according to the present invention comprises molded support having a generally U-shaped cross section with a plurality of adjustable straps attached to the molded support and extending across the U-shaped cross section. The adjustable straps are designed to allow movement into the U-shaped section during adjustment. Each strap is attached to the molded support and extends through a buckle arrangement provided on a rear face of the molded support. Each buckle arrangement is movable between a release position, allowing adjustment of the length of the strap across the U-shaped section, to a locked position where the strap is locked relative to the buckle arrangement. Each strap also includes a bias arrangement urging the strap in a direction to draw the strap across the U-shaped section when the respective buckle arrangement is in a release position.

According to an aspect of the invention, the bias arrangement is attached to a rear surface of the molded support and acts on a portion of each strap located on the rear surface after the strap passes through the buckle arrangement.

According to a further aspect of the invention, one end of each strap is connected to a rear surface of the molded support and an opposite end of the strap passes through the buckle arrangement. The bias arrangement is an independent bias arrangement associated with each strap and includes an elastic member with one end thereof attached to one end of the respective strap and opposite end of the elastic member held in fixed position relative to the molded support.

According to yet a further aspect of the invention each independent bias member is attached to a rear surface of the molded support.

A backrest according to the present invention comprises a molded support, a series of adjustable straps extending across the molded support, a releasable lock means for engaging each strap and maintaining a set relationship of each strap relative to the molded support when the lock means is in a locked position. Each strap includes a bias arrangement for urging the strap towards an initial set position where the strap is tensioned across the front cavity of the molded support when the releasable lock means is released and said strap is able to move relative to the releasable lock means.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
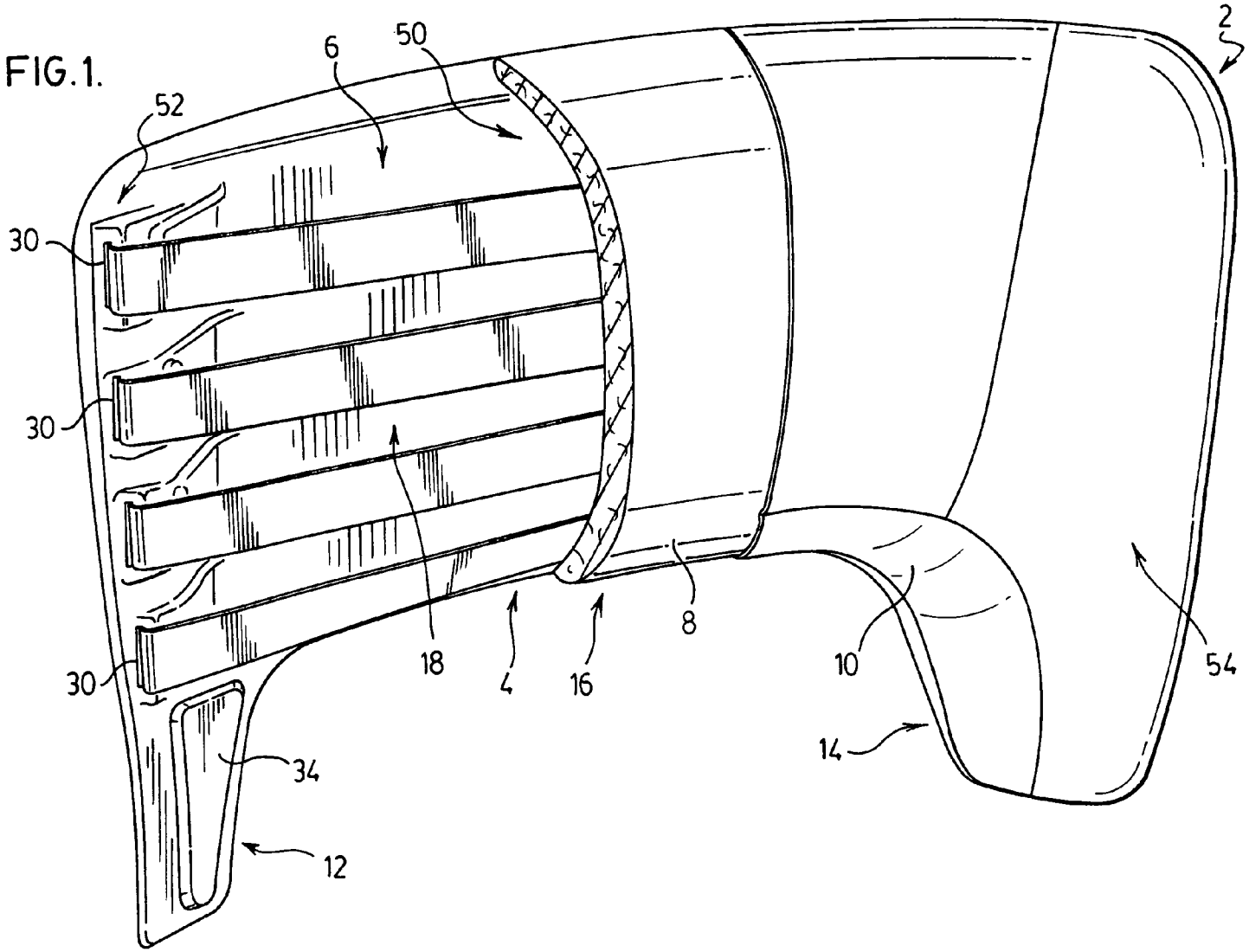
FIG. 1 is a partial perspective view showing details of the backrest.
Figure 2:
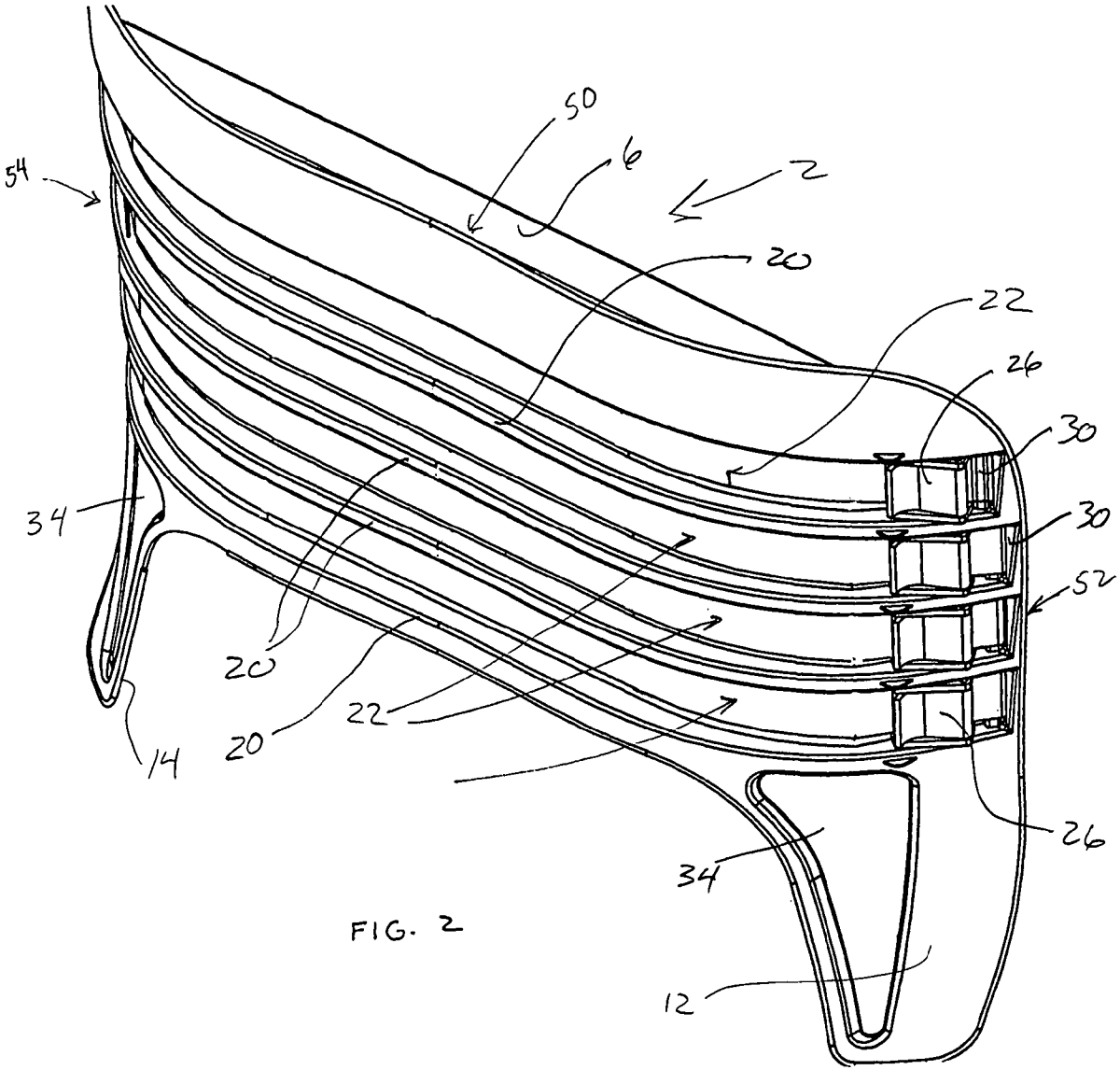
FIG. 2 is a rear perspective view of the molded support and strapping system used as part of the backrest.
Figure 5:
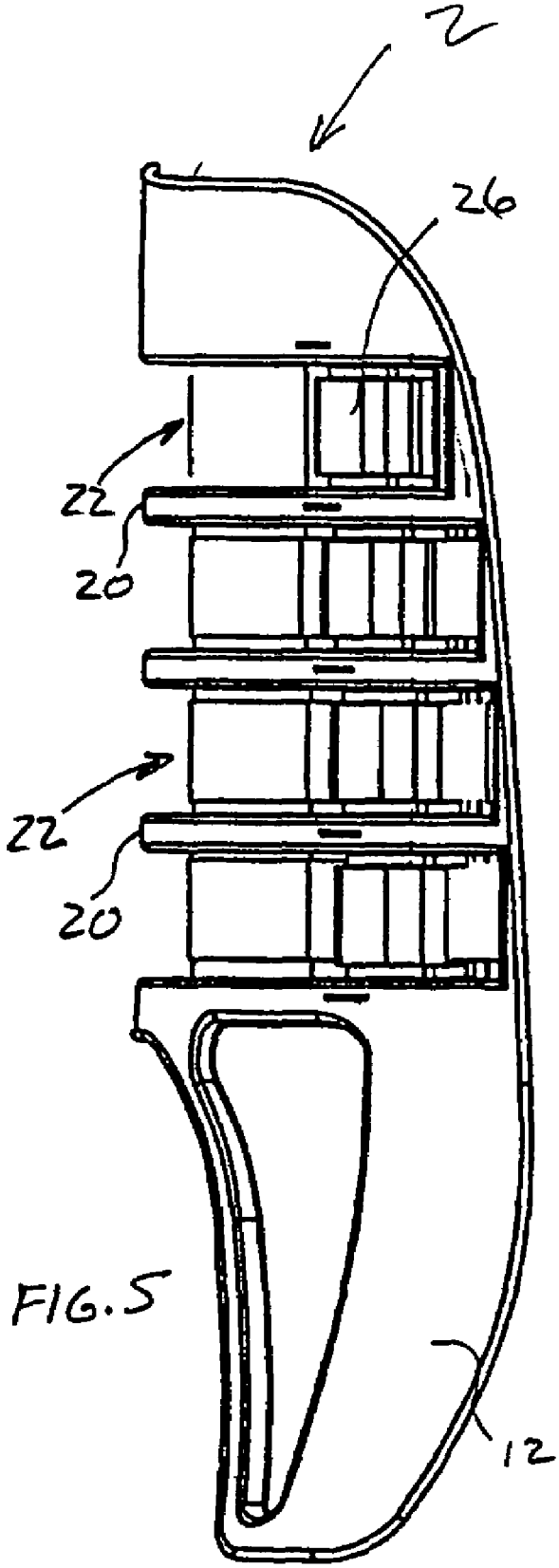
FIG. 5 is a right side view of the molded support of FIG. 4.
Figure 3:
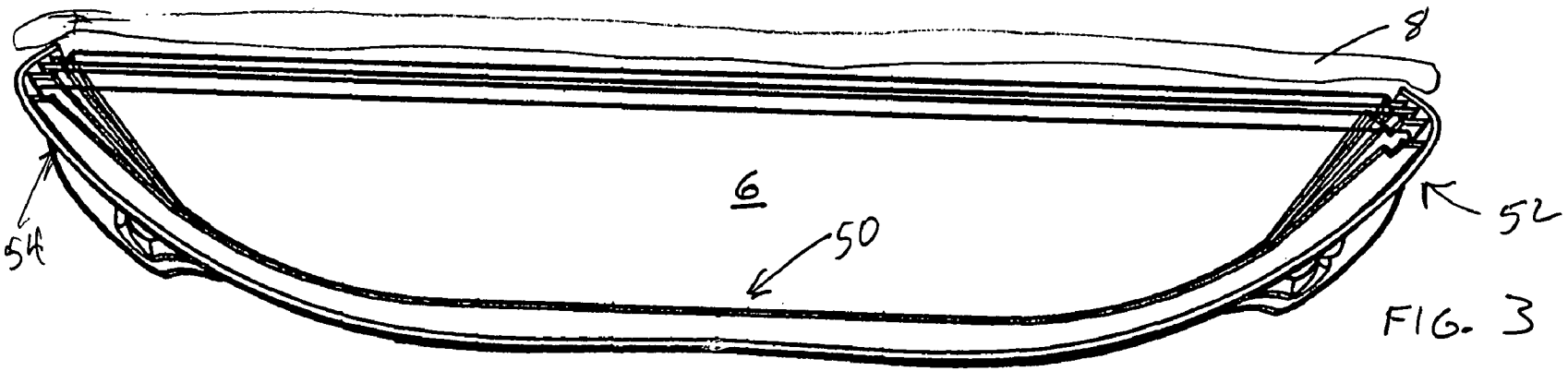
FIG. 3 is a top view of the molded support and straps.
Figure 4:
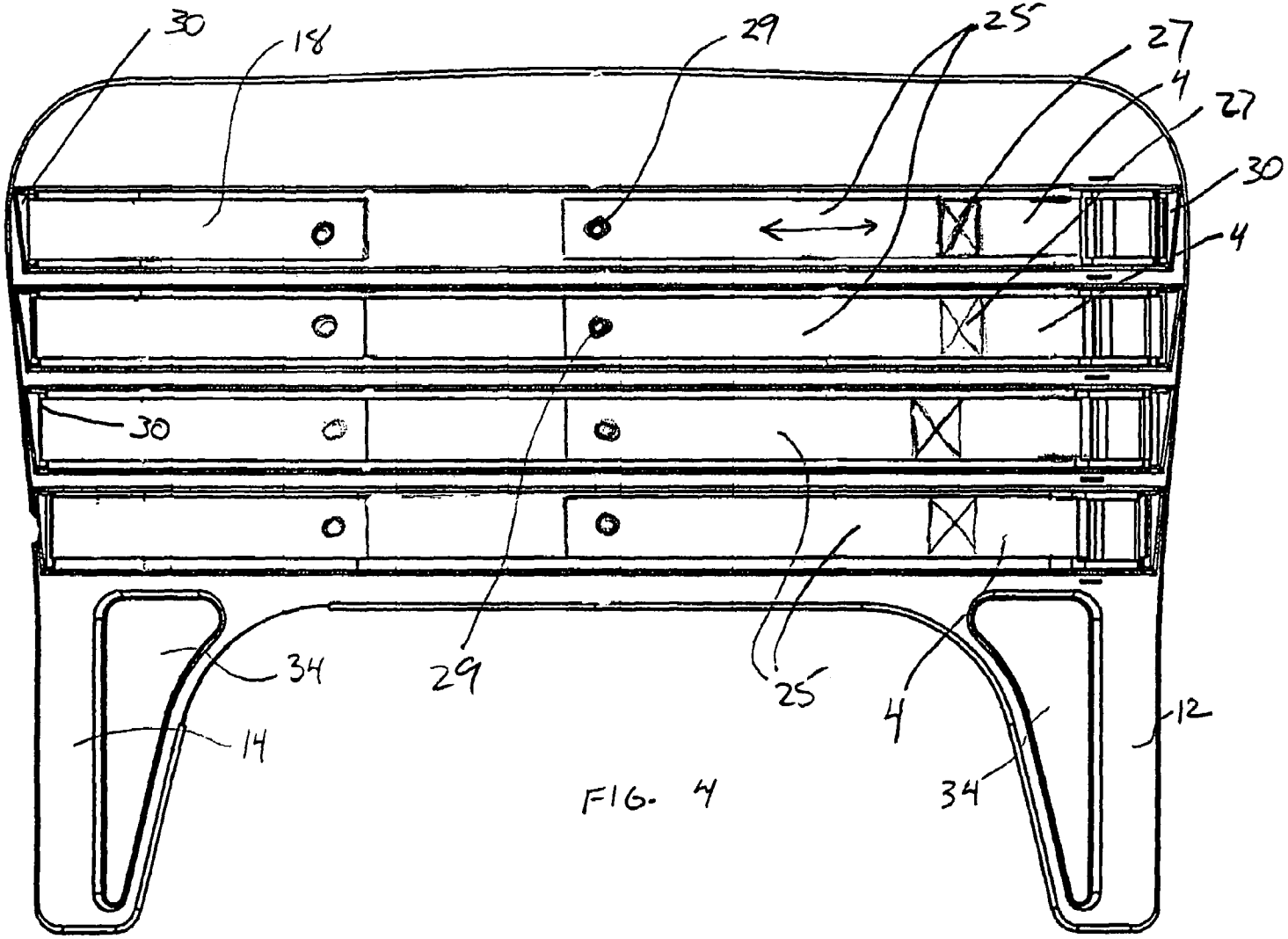
FIG. 4 is a rear perspective view of the molded support and straps.

The backrest 2 as shown in FIG. 1 is of a composite construction and includes a molded backrest support 4, a series of adjustable straps 6, a foam cushion overlay 8 (partially shown), and a contoured cover 10 (partially shown). The molded backrest support 4 includes the intermediate joining section 50 and opposed side support sections 52 and 54 which are connected to and slightly forward of the intermediate joining section 50. This structure defines a shallow U-shaped cavity and a series of adjustable straps 6 extend across this cavity to provide customized support for a person's lower back. Each of the side support sections have downwardly extending legs 12 and 14 positioned on opposite sides of the backrest. The intermediate joining section 50 is located above the legs and in combination with these legs define an open bottom cavity 16. The straps 6 in combination with the intermediate joining section define a raised adjustable back support 18.

The intermediate joining section 50 and the opposed side support sections 52 and 54 are relatively stiff and in contrast to the legs 12 and 14 that can deflect outwardly. This deflection out and back provides adjustment for users of larger spans across the hips. In this way the "U" shaped center cavity is maintained for variable strap support while the open center section and deflecting legs provide additional comfort and adaptability for different users.

The molded backrest support 4 has a series of horizontally extending reinforcing ribs 20 which extend outwardly from the rear surface of the molded support. Recessed channels 22 are located between adjacent ribs and these recessed channels receive and support the straps 6 on the rear surface of the molded backrest support 4. In this way, the straps are retained in the channels and keep their spacing across the rear surface of the molded support. Each strap includes on a rear surface of the backrest molded support, a bias member 24 preferably in the form of an elastic member which provides a bias force urging the respective strap to be tensioned across the U-shaped cavity when the respective buckle 26 is in a release position.

Each bias member 25 is preferably stitched to the associated strap 6. The bias members are attached to the molded backrest support by rivets 29. The straps 6 are of a strong reinforced fabric and are basically of fixed length with respect to the normal loads applied to the backrest. One end of each strap is fixed by one of the rivets or other fastener 29 and a buckle 26 selectively locks the strap in a desired support position across the "U" shaped cavity of the molded backrest support. Release of a buckle with no support load on the strap allows the bias member to draw the strap to an initial position slightly tensioned across the "U" shaped cavity.

The bias member 29 also serves a further function. With the buckles in a release position, all straps return to a neutral starting point for user adjustment. The user can then follow the recommended adjustment procedure with the straps moving through the associated buckle due to the bias force or the user applied force. A desired strap position is maintained by engaging the associated buckle. Each strap on the rear surface of the molded backrest support 4 includes a buckle 26 for selectively locking the strap in a desired configuration. Each strap passes through receiving slots 30 provided either side of the backrest and these slots serve to maintain the straps relative to the shallow U-shaped cavity. The molded legs 12 and 14 are of a generally triangular shape and include offset reinforcing gussets 34 integral with the legs. The legs serve to position the raised back support 18 approximately four to six inches above the supporting surface such as a desk chair, task chair.

The foam cushion overlay 8, on its rear surface, can have open channels for maintaining the straps in spaced relationship one to the other. The adjustable back support 18 is approximately 18 inches in height and each of the straps can be adjusted relative to the U-shaped cavity to define different support positions. As the raised adjustable back support 18 can be customized by any user, the backrest 2 is generic and different sizes thereof are not required.

In use, an initial setup procedure is required. The molded backrest support 4 is relatively rigid whereas the straps 6 with the buckles 26 in a release position are adjustable in length across the U-shaped cavity. In the setup procedure, the user releases all of the buckles and the bias member 25 for each strap pulls or assists in pulling the respective strap urging the strap to a tensioned state of reduced length across the shallow U-shaped cavity. The user then takes the backrest 2 and positions the backrest generally about his hips with the small of the person's back opposite the raised adjustable back support 18.

A person typically sits up straight in a chair and then moves back against the backrest and pushes into the U-shaped cavity such that the straps conform to the general shape of the small of the person's back. This adjustment procedure assists in having the back of the user relatively straight with the raised adjustable back support 18 conforming to the profile of the person's spine when in this desired posture. Once adjusted, the buckles 26 are locked and the backrest remains in this desired custom configuration.

The opposed legs 12 and 14 position the backrest support on the chair with the proper elevation of the back support portion and a person pushing into the backrest will have a series of support positions determined by the adjustable straps which have been customized to the desired shape. The compressible foam provides some additional comfort and serves to marginally distribute forces evenly across the supported back portion. The contoured cover provides limited, additional support and preferably accommodates breathability to reduce moisture retention.

The biasing members and the fixed attachment of the straps to the molded support provide a system which is easy to use and easy to adjust. The biasing members provide a force urging the straps to be drawn across the U-shaped cavity, however, some user force may be appropriate to assist in drawing the strap to the desired initial setup position. The biasing members assist in returning the straps to a neutral setup position when the buckles are released. The biasing member remains in a tensioned state when the backrest has been set by locking the straps using the buckles. There is no need to change the set position unless a different person is to customize the backrest for his use. Although the device does provide for quick adjustment between users, the structure is relatively inexpensive to produce and individual back supports may be preferred. The biasing arrangement assists in returning the straps to the neutral setup position and reduces the probability of inaccurate setup. The bias arrangement provides a tension force urging the strap to conform to the shape of the user during the setup procedure. This provides a good fit, responds to changes in position during fitting and reduces the probability of incorrect setup.

As outlined in the background of the invention, proper back support is highly desirable and can directly impact productivity. If the back support does provide advantages to the user, there is a tendency to keep the backrest personal to maintain the performance characteristics thereof.

The backrest support has been shown with a full contoured cover 10 having an access port or flap for gaining access to the buckles at one side of the molded support 4. The purpose of the cover 10 and foam overlay 8 are to add comfort and provide an "upholstered look" finished product suitable for office applications where appearance may be important.

It is also possible to use a different cover, for example, a sleeve cover and foam in the center section of the backrest support. Thus the cover is in a central section leaving the opposite sides of the backrest open. A single sided cover with or without foam could also be used. In this case, the molded backrest could include engaging slots on the back thereof for retaining the edge of the foam and cover, much in the manner that screening is maintained within a frame.

From the above it can be understood that the cover 10 and foam 8 provide some additional comfort and finish to the product. The molded backrest and adjustable strapping provide the support function. For this reason it is possible to produce a backrest without the cover and foam. This product functions well and can be produced at lower costs. To improve the appearance, a plastic insert or cloth cover could be attached to the molded backrest on the front surface thereof and behind the straps.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A backrest comprising:

a molded support having a generally "U" shaped cross section with a plurality of adjustable straps attached to said molded support and extending across said "U" shaped cross section with each of the plurality of straps being adjustable to allow the strap to partially move into said "U" shaped section;

each strap is attached to said molded support and extends through a buckle arrangement provided on a rear face of said molded support;

each buckle arrangement is movable between a release position allowing adjustment of the length of strap across the "U" shaped section and a locked position, where the strap is locked, relative to the buckle arrangement;

each strap also includes a bias arrangement automatically urging each strap in a direction to draw the strap across said "U" shaped section to an initial set position when the respective buckle arrangement is in a release position.

2. A backrest support as claimed in claim 1, wherein said bias arrangement is attached to a rear surface of said molded support and acts on a portion of each strap located on said rear surface after the strap has passed through the buckle arrangement.

3. A backrest support as claimed in claim 1, wherein one end of each strap is connected to a rear surface of said molded support, and an opposite end of said strap passes through said buckle arrangement.

4. A backrest support as claimed in claim 3 wherein said bias arrangement is a series of independent bias members, each associated with one of said straps.

5. A backrest support as claimed in claim 4 wherein each independent bias arrangement is an elastic member with one end thereof attached to one end of the respective strap and an opposite end of the elastic member held in a fixed position relative to said molded support.

6. A backrest support as claimed in claim 5, wherein each strap and each independent bias member is attached to said rear surface of said molded support.

7. A backrest comprising:

a molded support;

a series of adjustable straps extending across said molded support;

a releasable lock means for engaging each strap and maintaining a set relationship of the strap, relative to said molded support when said lock means is in a lock position;

each strap including a bias arrangement for urging the strap towards an initial set position, where the strap is drawn across a front cavity of said molded support when said releasable lock means is released, and said strap is able to move relative to the releasable lock means.

8. A backrest support comprising a molded support a series of adjustable straps extending across said molded support;

a releasable lock means for engaging each strap and maintaining a set relationship of the strap, relative to said molded support when said lock means is in a lock position;

said molded support defining a "U" shaped cavity with a series of reinforcing ribs extending across at least a base of the "U" shaped cavity; and said molded support having on a rear surface of the base of said "U" shaped cavity a series of channels with each strap being secured within one of said series of channels.

9. A backrest support comprising a molded support a series of adjustable straps extending across said molded support;

a releasable lock means for engaging each strap and maintaining a set relationship of the strap, relative to said molded support when said lock means is in a lock position;

said molded support defining a "U" shaped cavity with a series of reinforcing ribs extending along the "U" shaped cavity; and said molded support having on a rear surface of said "U" shaped cavity a series of channels with each strap being secured within one of said series of channels wherein said "U" shaped cavity includes two downwardly extending support legs with the support legs being positioned either side of said "U" shaped cavity.

10. A backrest support as claimed in claim 9 wherein said support legs are outwardly and rearwardly resiliently deflectable.

11. A backrest support as claimed in claim 10 wherein said "U" shaped cavity is stiff relative to said support legs in normal operating conditions of said backrest support.

* * * * *